US005707271A

United States Patent [19]

Kunz et al.

[11] Patent Number: 5,707,271

[45] Date of Patent: Jan. 13, 1998

[54] TOY CAR HAVING SKIDS POSITIONED OVER THE WHEELS

[75] Inventors: Philippe Kunz, Ebertswil; Heinz Looser, Baar; Werner Tanner, Zug, all of Switzerland

[73] Assignee: INTERLEGO AG, Baar, Switzerland

[21] Appl. No.: 665,894

[22] Filed: Jun. 19, 1996

[30] Foreign Application Priority Data

Jul. 1, 1995 [DE] Germany ..... 195 24 038.3

[51] Int. Cl.[6] ..... A63H 17/00; A63H 33/08; A63H 17/25

[52] U.S. Cl. ..... 446/437; 446/128; 446/288

[58] Field of Search ..... 446/437, 431, 446/448, 449, 128, 96, 95, 94, 273, 274, 275, 277, 278, 279, 280, 287, 288, 292

[56] References Cited

U.S. PATENT DOCUMENTS

| | | | |
|---|---|---|---|
| D. 346,629 | 5/1994 | Ruszkai | 446/128 X |
| 1,654,327 | 12/1927 | Fuld . | |
| 1,791,730 | 2/1931 | MacBride | 446/288 |
| 2,649,805 | 8/1953 | Lohr | 446/286 |
| 3,221,445 | 12/1965 | Riva . | |
| 3,359,680 | 12/1967 | Lindsay | 446/286 |
| 5,380,232 | 1/1995 | Berggreen et al. | 446/128 X |
| 5,474,483 | 12/1995 | Sun | 446/431 X |

FOREIGN PATENT DOCUMENTS

| | | | |
|---|---|---|---|
| 2347071 | 11/1977 | France . | |
| 440561 | 2/1927 | Germany . | |
| 1818362 | 9/1968 | Germany . | |
| 8914031 | 2/1990 | Germany . | |
| 525904 | 9/1940 | United Kingdom | 446/437 |
| 2161087 | 1/1986 | United Kingdom | 446/288 |

*Primary Examiner*—D. Neal Muir

*Attorney, Agent, or Firm*—Kane,Dalsimer,Sullivan, Kurucz, Levy, Eisele and Richard, LLP

[57] ABSTRACT

A toy car (1) is provided which has a car box (10) on which two wheels (20) are rotatably mounted. Each wheel (20) has an eccentric disc (21) at the side facing the car box (10). The sidewalls (16) of the car box (10) have longitudinal grooves (27). These are engaged by guide cams of skid places over the corresponding wheel (20). When the car is pulled, the wheels rotate, the eccentric disc (21) moves which causes the skid to reciprocally move. The car thus simulates foot movement.

12 Claims, 2 Drawing Sheets

TOY CAR HAVING SKIDS POSITIONED OVER THE WHEELS

BACKGROUND OF THE INVENTION

The invention relates to a toy car that is more appealing to children.

There are many types of toy cars which rely on a crank responsive to rotation of the car wheels to move parts of the car. This type of car has many variations, all of which are well known. For example, DE-PS 440 561 discloses such a car.

However, most of these toy cars are built for a predetermined purpose or for a particular way of playing with the cars. Therefore, the cars are less attractive to children. Thus, children will choose to play with other toys. If a child does choose to play with the toy car, it is less likely to maintain the child's interest over long periods.

OBJECTS AND SUMMARY OF THE INVENTION

It is therefore an object of the present invention to provide a toy car that may be used in a variety of ways.

It is another object of the invention to provide a toy car which is more exciting for a child to use and which stimulates the child's interest.

These objects are solved by a toy car in accordance with the invention which comprises a car box on which two wheels are rotatably mounted. Each wheel has an eccentric disc at the side facing the car box. The sidewalls of the car box have longitudinal guide grooves. These are engaged by guide cams of a skid placed over the corresponding wheel. When the car is pulled, the wheels rotate and the eccentric discs move, which causes the skids to reciprocally move with respect to the box. The movement of the skids thus simulates a walking movement.

BRIEF DESCRIPTION OF THE DRAWINGS

The preferred embodiment of the invention is described in conjunction with the following drawing figures.

DETAILED DESCRIPTION OF THE PREFERRED EMBODIMENT

Figure 1:
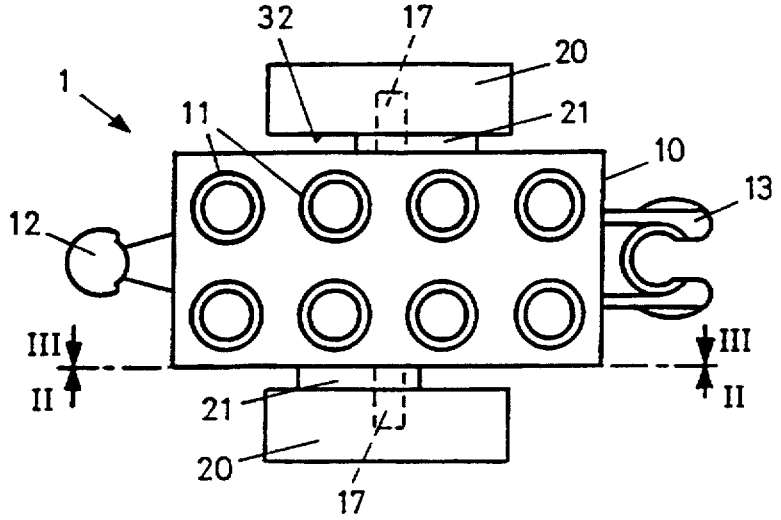
FIG. 1 is a top plan view of the toy car in accordance with the invention.
Figure 2:
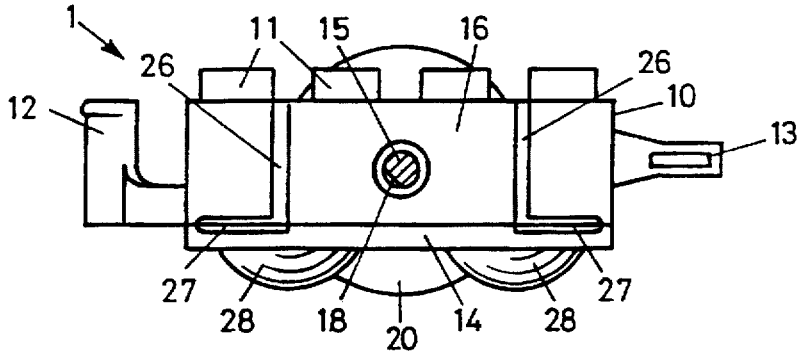
FIG. 2 is a sectional view thereof taken along line II—II in FIG. 1.

The car 1 shown in FIG. 1 and 2 has a car box 10. The box 10 is constructed as a hollow plug-in building block with coupling studs 11. The studs 11 are used to engage tubes in other elements of a set to mount such other building blocks or figure blocks to the box. The box 10 includes couplers 12, 13 at the front and rear ends thereof for coupling a plurality of such cars 1.

Box 10 is closed by a bottom plate 14. A shaft 15 penetrates or extends through the longitudinal center of box 10 and is rotatably mounted in the side walls 16 of the box 10. The shaft 15 has lugs 17 which protrude outside of the box 10 for mounting wheels 20. Each lug 17 has a one-sided flat portion 18. The flattened portions 18 of the protruding lugs 17 are offset with respect to each other by about 180°.

On each of the wheels 20, there is formed an eccentric disc 21. This disc 21 is a non-concentric cylinder (with respect to the wheel) extending from the wheel side which faces the side 16 of the box 10. Each eccentric disc 21 also has a portion on the inner surface 21*b* thereof with a bore for receiving the lug 17 of the shaft 15. The eccentricities of the discs 21 are offset at an angle of 180 degrees with respect to each other.

The Box 10 has two vertical guide grooves 26 and two horizontal guide grooves 27 which are aligned with each other. The grooves 26, 27 extend in each sidewall 16 of the box 10. Two support balls 28 are also inserted in the car box 10, whose common lower tangential plane crosses the wheels 20.

Figure 3:
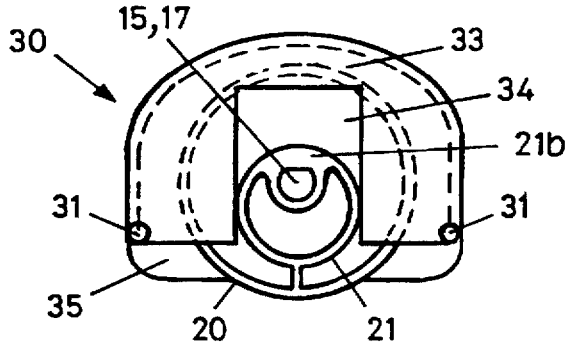
FIG. 3 is a sectional view thereof taken along line III—III in FIG. 1.
Figure 4:
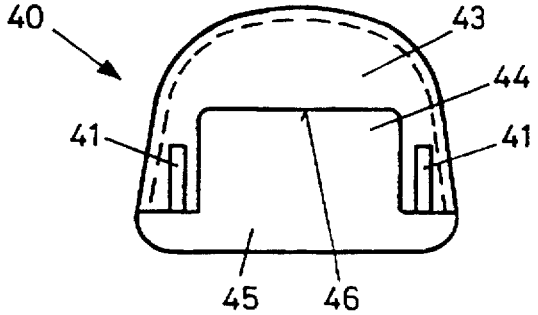
FIG. 4 is a view of a skid.

In FIGS. 3 and 4, there are shown skids 30, 40 which may be placed over the wheels 20.

Specifically, the skid 30 is designed for reciprocal horizontal movement. Reciprocal movement is defined herein as back and forth movement (horizontal or vertical). For this purpose, the skid 30 is provided with two cams 31 at the sidewall 33 which engages the inner face 32 of the wheel 20. These cams 31 engage and move within the grooves 27. The skid 30 has a sidewall 33, a vertical slot 34 formed therein and an outer wall 35. The slot 34 has a width that is slightly larger than the diameter of the eccentric disc 21 to allow the disc 21 to move within the slot 34. The outer wall 35 of the skids 30 covers most of the wheel 20.

In operation, when the skid 30 is properly mounted over the wheel, the eccentric disc 21 moves in a circular motion in response to rotation of the wheels 20, the cams 31 move horizontally within the grooves 27 and the skid 30 moves horizontally back and forth (reciprocally) when the wheels 20 are rotated. Thus a walking movement is simulated.

A somewhat modified skid 40 is shown in FIG. 4 Skid 40 differs from the skid 30 shown in FIG. 3 in that the skid 40 is designed for reciprocal vertical movement with respect to the box 10. The skid 40 has vertical guide bars 41 which are positioned within grooves 26 and a slot 44 in sidewall 43 of the skid 40. The slot 44 has an upper edge 46 for engaging the eccentric disc 21. The slot 44 has a width that is much larger than the diameter of the eccentric disc 21, so that the sidewalls of the slot 44 do not interfere with the movement of the eccentric disc 21.

In operation, when the skid 40 is positioned over the wheels 20, the eccentric disc 21 moves in a circular motion in response to the rotation of the wheel 20. The eccentric disc 21 engages the upper edge 46 of the slot 44 which causes the guide bars 41 to move vertically up and down within the grooves 26 and causes the skid 40 to move vertically up and down (reciprocally). The outer wall 45 covers most of the wheel 20.

The pair of skids 30 or 40 are detachably mounted over the wheels 20 so that one pair of skids 30 can be substituted by a pair of skids 40 and vice versa.

Figure 5:
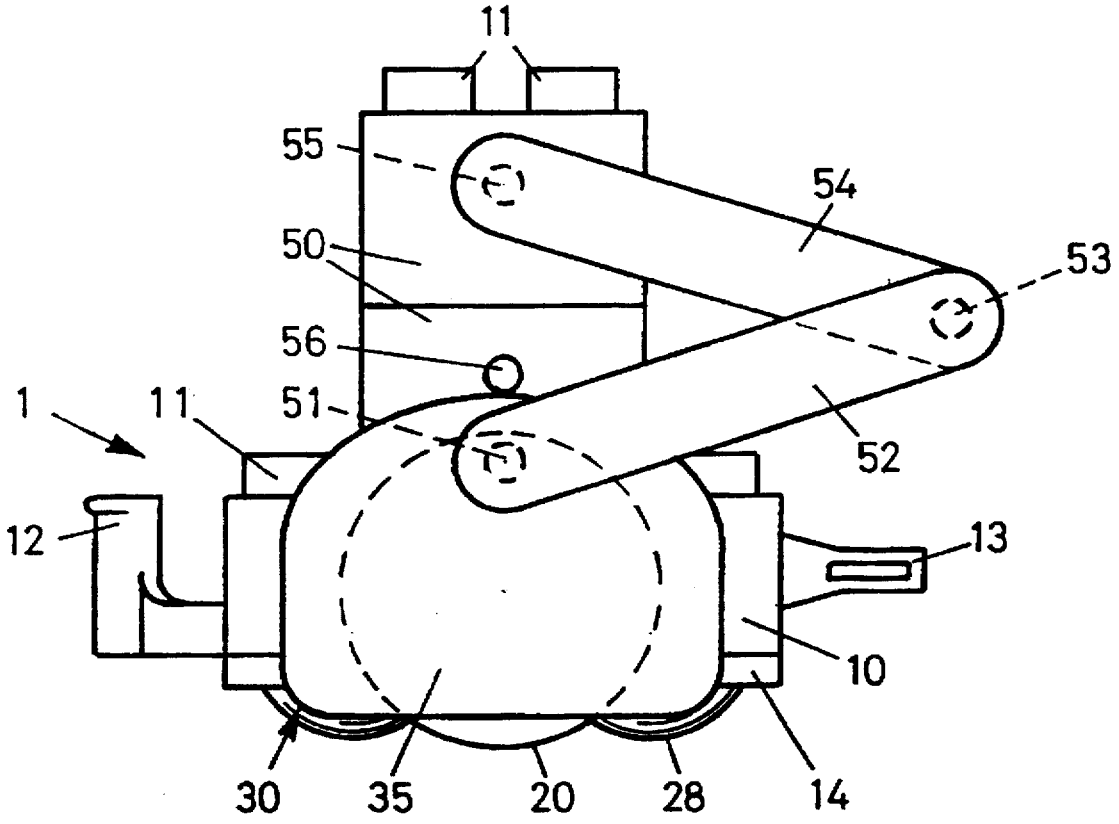
FIG. 5 is a side view of the toy car with building blocks coupled thereto.

FIG. 5 shows the use of the toy car 1 with skid 30. There are shown two additional building blocks 50 mounted to the top of car box 10 through the stud and tube arrangement of the block set. Skid 30 has a center bore 51 positioned in the upper portion of sidewall 35 of the skid 30.

FIG. 5 also shows a joint arm 52 which has two ends, one with a pin mounted within the bore 51 and the other connected to a second joint arm 54 via joint 53. The remaining end of arm 54 is provided with a pin 55 which is inserted into a bore 56 of upper building block 50. This construction simulates a leg movement.

By coupling several cars together, a more attractive and appealing toy is constructed which will stimulate a child's mind and maintain a child's interest.

We claim:

1. A toy car comprising:

a box;

a pair of wheels;

an axle rotatably mounted on said box and supporting said wheels on opposite sides of said box;

a first disc and a second disc eccentrically formed on an associated side of said wheels facing said box respectively;

a first pair of skids positioned over said wheels respectively, and reciprocally movable in response to said first and second discs when said wheels are rotated, an outside wall of said skids covering a major part of outside faces of said wheels wherein said skids are guided by horizontal guide elements on sides of said box for horizontal reciprocal motion.

2. The toy car of claim 1 wherein eccentricities of said discs are offset by an angle of 180 degrees with respect to each other.

3. The toy car of claim 1 wherein each skid has means for supporting a pin of a joint arm.

4. The toy car of claim 3 wherein said box has coupling elements on an upper face thereof for connection with other building blocks or figures having mating coupling elements.

5. A toy car comprising:

a box;

a pair of wheels;

an axle rotatably mounted on said box and supporting said wheels on opposite sides of said box;

a first disc and a second disc eccentrically formed on an associated side of said wheels facing said box respectively;

a first pair of skids positioned over said wheels respectively, and reciprocally movable in response to said first and second discs when said wheels are rotated, an outside wall of said skids covering a major part of outside faces of said wheels wherein said skids are guided by vertical guide elements on sides of said box for vertical reciprocal motion.

6. The toy car of claim 5 wherein eccentricities of said discs are offset by an angle of 180 degrees with respect to each other.

7. The toy car of claim 5 wherein each skid has means for supporting a pin of a joint arm.

8. The toy car of claim 7 wherein said box has coupling elements on an upper face thereof for connection with other building blocks or figures having mating coupling elements.

9. A toy car comprising:

a box;

a pair of wheels;

an axle rotatably mounted on said box and supporting said wheels on opposite sides of said box;

a first disc and a second disc eccentrically formed on an associated side of said wheels facing said box respectively;

a first pair of skids positioned over said wheels respectively, and reciprocally movable in response to said first and second discs when said wheels are rotated, an outside wall of said skids covering a major part of outside faces of said wheels wherein said box includes vertical and horizontal guide elements on each side of said box and wherein said first pair of skids is detachably mounted over said wheels and includes first engagement means for engaging said horizontal guide elements, said toy car further comprising a second pair of skids for a detachable mounting over said wheels in replacement of said first pair of skids, said second pair of skids including second engagement means for engaging said vertical guide elements.

10. The toy car of claim 4 wherein eccentricities of said discs are offset by an angle of 180 degrees with respect to each other.

11. The toy car of claim 4 wherein each skid has means for supporting a pin of a joint arm.

12. The toy car of claim 11 wherein said box has coupling elements on an upper face thereof for connection with other building blocks or figures having mating coupling elements.

* * * * *

UNITED STATES PATENT AND TRADEMARK OFFICE

CERTIFICATE OF CORRECTION

PATENT NO. : 5,707,271

DATED : January 13, 1998

INVENTOR(S) : Philippe Kunz, et al.

It is certified that error appears in the above-identified patent and that said Letters Patent is hereby corrected as shown below:

Claim 10, line 1, change the dependency from claim 4 to claim 9.

Claim 11, line 1, change the dependency from claim 4 to claim 9.

Signed and Sealed this

Fourteenth Day of April, 1998

Bruce Lehman

*Attest:*

BRUCE LEHMAN

*Attesting Officer*

*Commissioner of Patents and Trademarks*